US006686685B2

(12) United States Patent
Hollinger

(10) Patent No.: US 6,686,685 B2
(45) Date of Patent: Feb. 3, 2004

(54) APERTURE GRILL FOR USE IN CATHODE RAY TUBE AND METHOD FOR PRODUCING SAME

(75) Inventor: Paul A. Hollinger, Leechburg, PA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 10/308,400

(22) Filed: Dec. 3, 2002

(65) Prior Publication Data

US 2003/0080667 A1 May 1, 2003

Related U.S. Application Data

(62) Division of application No. 09/512,404, filed on Feb. 24, 2000, now Pat. No. 6,508,945.

(51) Int. Cl.[7] ..... H01J 29/80
(52) U.S. Cl. ..... 313/407; 313/402
(58) Field of Search ..... 313/402, 407, 313/404

(56) References Cited

U.S. PATENT DOCUMENTS

| | | | | |
|---|---|---|---|---|
| 4,061,529 A | | 12/1977 | Goldman et al. | 430/5 |
| 4,504,764 A | * | 3/1985 | Sakamoto et al. | 313/407 |
| 5,200,025 A | | 4/1993 | Toei et al. | 156/345 |
| 5,348,825 A | | 9/1994 | Nakamura et al. | 430/321 |
| 5,362,357 A | | 11/1994 | Takei et al. | 216/12 |
| 5,567,555 A | | 10/1996 | Nakamura et al. | 430/29 |
| 5,585,224 A | | 12/1996 | Makita et al. | 216/33 |
| 5,709,804 A | | 1/1998 | Makita et al. | 216/12 |
| 6,354,902 B1 | | 3/2002 | Takei | 445/47 |

FOREIGN PATENT DOCUMENTS

| | | | |
|---|---|---|---|
| JP | 05174707 A | 7/1993 | H01J/9/14 |
| JP | 07037492 A | 2/1995 | H01J/9/14 |
| JP | 11339651 A | 12/1999 | H01J/9/14 |
| JP | 2000089456 A | 3/2000 | G03F/7/027 |
| JP | 2000181057 A | 6/2000 | G03F/7/027 |

* cited by examiner

*Primary Examiner*—Vip Patel
(74) *Attorney, Agent, or Firm*—Mayer Fortkort & Williams, PC; Michael P. Fortkort; Karin L. Williams

(57) ABSTRACT

A lightweight cathode ray tube is formed by reducing a cross-sectional area on the apeture grill tapes in the aperture grill. One exemplary embodiment of the reduced cross-sectional area aperture grill tape includes a central longitudinal channel in a side of the aperture grill tape that faces away from the screen. The reduction in cross-sectional area reduces a linear density of the tape thereby decreasing the tension required by the frame. As each of the aperture grill tapes includes this central longitudinal channel, the weight of the overall aperture grill is significantly reduced and the aperture grill frame weight is reduced due to the lower aperture grill tension. A method for producing the reduced cross-sectional area aperture grill tape is possible without significantly increasing the cost of manufacturing the aperture grill tape. One exemplary embodiment of this method includes a two-step etching process, in which one of the etching steps involves etching both sides of the aperture grill, during which step a central longitudinal channel is etched in each of the aperture grill tapes and the other etching step involves etching the screen side of the aperture grill only.

10 Claims, 4 Drawing Sheets

APERTURE GRILL FOR USE IN CATHODE RAY TUBE AND METHOD FOR PRODUCING SAME

CROSS-REFERENCE TO RELATED APPLICATIONS

This Application is a division of U.S. patent application Ser. No. 09/512,404, filed Feb. 24, 2000 and now U.S. Pat. No. 6,508,945 entitled "Aperture Grill For Use In Cathode Ray Tube And Method For Producing Same".

BACKGROUND OF THE INVENTION

A conventional "Trinitron" cathode ray tube (CRT) employs an aperture grill welded to a frame under tension. The frame adds weight and cost to the CRT. One conventional implementation of the aperture grill consists of parallel strips or tapes of metal attached to the frame. Each of the tape strips is called an aperture grill tape.

One of the key considerations for the size (and thus the weight) of the aperture grill frame is the tension required to produce a specified natural frequency for each of the aperture grill tapes. The natural frequency is in turn associated with the visual picture quality.

The natural frequency for each of the aperture grill tapes is described by the equation of a standing wave:

$$F_n = \frac{n}{2L}\left(\frac{T}{\mu}\right)^{1/2}$$

where $F_n$=natural frequency (Hertz), n=1, 2, 3, . . . represents the order of the mode, L=length (m), T=tension (kg), $\mu$=linear density (mass per unit length, kg/m). From the above equation, one critical factor for the aperture grill tape is the linear density ($\mu$), which in turn is a function of the cross-sectional area of the aperture grill tape.

One technique for reducing the cross-sectional area of the aperture grill tape is to produce the aperture grill from thinner material. Thinner aperture grill material costs more than thicker aperture grill material due to the additional processing required to achieve the thinner material. Moreover, thinner material generally has lower manufacturing yields than a comparable aperture grill of thicker material, which also increases the cost of aperture grill manufacturing.

Another technique for reducing the aperture grill tape cross-sectional area is to vary the screen side bevels (or tapers). One difficulty with this approach is that it can create or compound other subtle visual defects, which reduce manufacturing yields.

The present invention is therefore directed to the problem of reducing the manufacturing cost of a cathode ray tube.

SUMMARY OF THE INVENTION

The present invention solves this problem by reducing the cross-sectional area of the aperture grill tape. One exemplary embodiment of the reduced cross-sectional area aperture grill tape includes a central longitudinal channel in a side of the aperture grill tape that faces away from the screen. The reduction in cross-sectional area reduces the linear density of the aperture grill tape, thereby decreasing the tension ($F_n$) required to achieve the desired natural frequency of the aperture grill tape. As each of the aperture grill tapes includes this central longitudinal channel, the weight of the overall aperture grill is significantly reduced. The weight of the aperture grill frame is reduced due to the overall reduction of required tension.

The present invention also includes a method for producing the reduced cross-sectional area aperture grill tape without significantly increasing the cost of manufacturing the tape. One exemplary embodiment of this method includes a two-step etching process, in which one of the etching steps involves etching both sides of the aperture grill, during which step a central longitudinal channel is etched in each of the aperture grill tapes and the other etching step involves etching the screen side of the aperture grill only.

DETAILED DESCRIPTION

Figure 1:
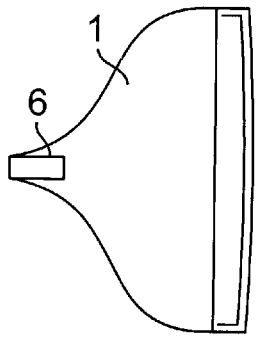
FIG. 1 (PRIOR ART)
FIG. 1 depicts a conventional "trinitron" cathode ray tube in cross section.
Figure 2:
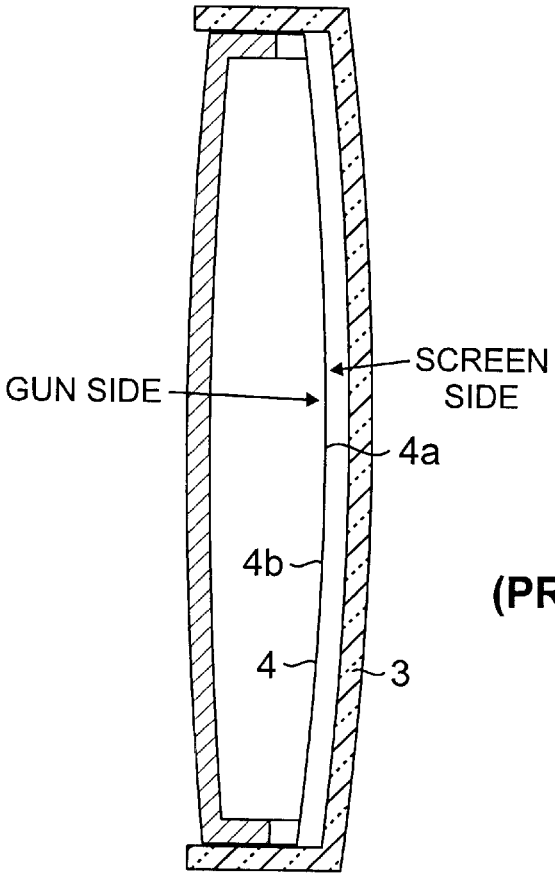
FIG. 2 (PRIOR ART)
FIG. 2 depicts a blow-up of a portion of the cathode ray tube in FIG. 1 showing the aperture grill in more detail.

Referring to FIG. 1, shown therein is a cathode ray tube (CRT) 1 in a cross-sectional view. The CRT 1 includes a frame 2, a panel glass 3 and an aperture grill 4, each of which can be seen in more detail in FIG. 2. The aperture grill 4 has two sides defined as a screen side 4*a*, which faces the screen 5, and a gun side 4*b*, which faces the electron beam gun 6.

Figure 3:
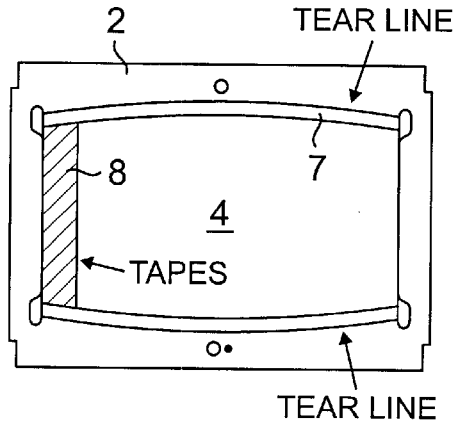
FIG. 3 (PRIOR ART)
FIG. 3 depicts a cross-sectional view of the aperture grill of FIG. 2 showing the use of multiple aperture grill tape across the screen.

Turning to FIG. 3, shown in a different cross-sectional view is the aperture grill 4 fastened to the frame 2 at a tear line 7. The aperture grill 4 includes multiple aperture grill tapes 8, each of which is held in tension by the frame 2.

Figure 4:
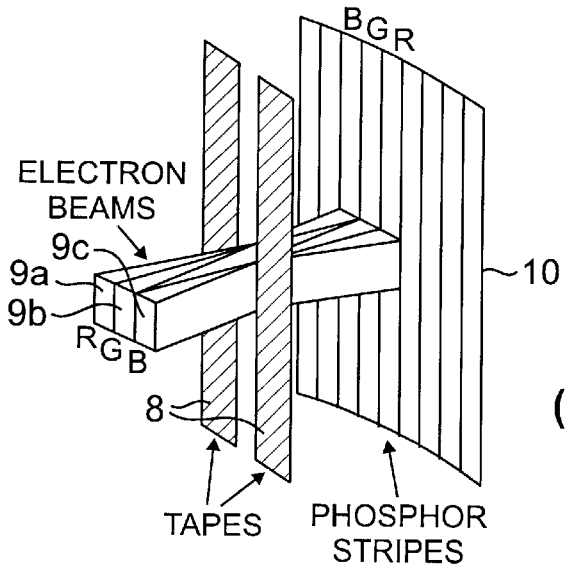
FIG. 4 (PRIOR ART)
FIG. 4 depicts the interaction of the aperture grill tapes with the electron beams of the cathode ray tube.

Turning to FIG. 4, the aperture grill tape 8 separates the red 9*a*, green 9*b* and blue electron beams 9*c* so they strike the phosphor stripes 10 on the screen 3.

Figure 5:
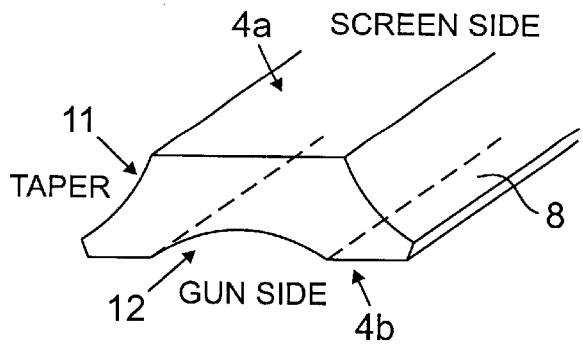
FIG. 5 depicts an exemplary embodiment of an aperture grill tape for use in the present invention.

Turning to FIG. 5, according to an exemplary embodiment of the aperture grill 4, each of the aperture grill tapes 8 has a reduced cross-sectional area formed on the gun side 4*b* between the tapers beveled edges 11. This reduces the required frame tension which in turn enables a reduction in the weight of the frame 2 by allowing use of a lighter frame, thereby reducing the overall cost of the CRT 1.

The present invention reduces the tape density of the aperture grill tape 8 by etching a longitudinal channel 12 in a center of the aperture grill tape 8 on the gun side 4*b* of the aperture grill 4. The channel 12 reduces the cross-section of the aperture grill tape 8 without the need for thinner metal or for variations on the screen side bevels or tapers 11.

Figure 6A:
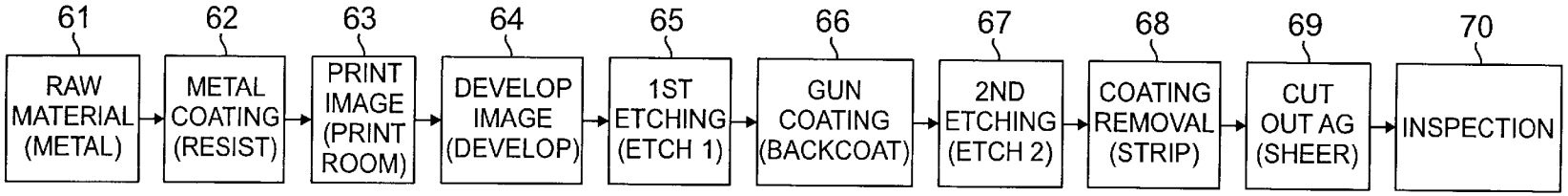
FIGS. 6*a* through 6*c* depict an exemplary embodiment of a process for manufacturing the exemplary embodiment shown in FIG. 5.
Figure 6D:
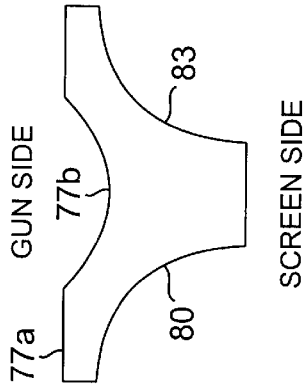
FIG. 6*d* depicts a cross section of one of the aperture grill tapes produced by the process of FIGS. 6*a* through 6*c*.
Figure 6B:
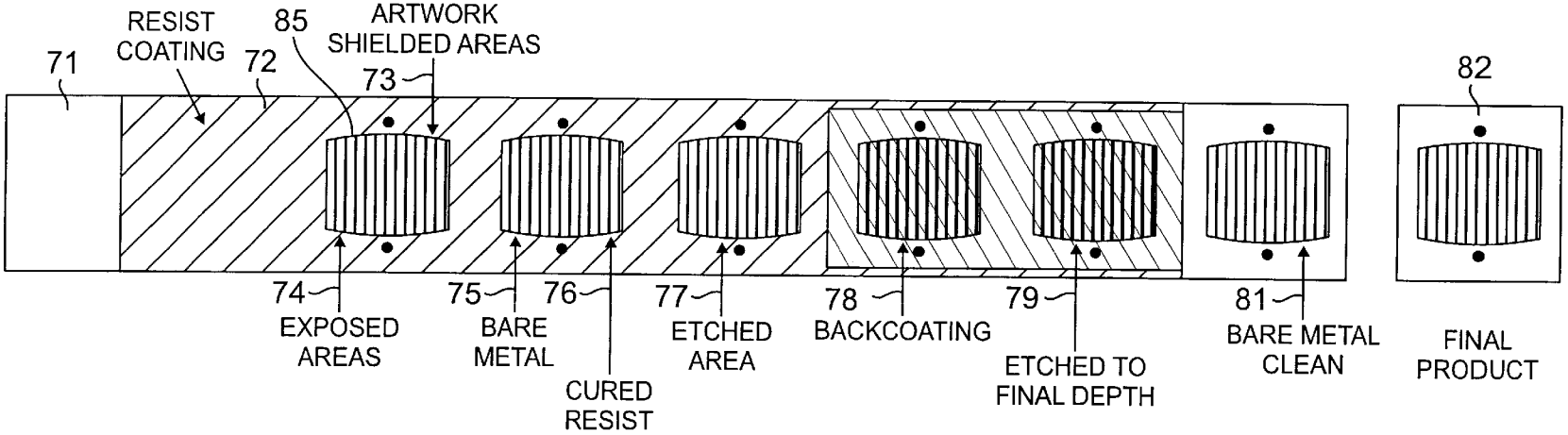

Referring to FIG. 6*a*, the aperture grill manufacturing process 60 employs a photolithography step (elements 63 and 64) to transfer the desired aperture grill features from a glass artwork (not shown) to the resist coated metal 71 (FIG. 6*b*). One exemplary embodiment of the metal is a steel tape having a width approximately 510 mm to 680 mm. The thickness of the steel tape can vary, but exemplary widths include 100, 130 and 150 $\mu$m.

The reduced tape density aperture grill artwork can be accomplished by increasing the pitch (i.e., the relative spacing frequency per unit length) of the gun side photoplate line features to double the gun side imaged lines. As the gun side etching is stopped after the first etching step 65, the gun side channel 77*b*, which does not have a screen side channel opposite to it, will not break through the tape 71 and will remain as only a gun side channel 77*b*, which reduces the cross-sectional area only. As the new etch feature 77*b* appears only in the center of the gun side 4*b* of the tape 71, no screen side 4*a* defects will result.

One embodiment for producing the aperture grill 4 of the present invention is to do so in a two step etching process 60 and will be easy to implement in a continuous two step etching process. Variations are possible utilizing multiple gun side channels or channels that would vary in size (larger or smaller) from the normal gun side first etch channel, all aimed at optimum tape density for manufacturing conditions or aperture grill frame designers weight requirements.

Figure 6C:
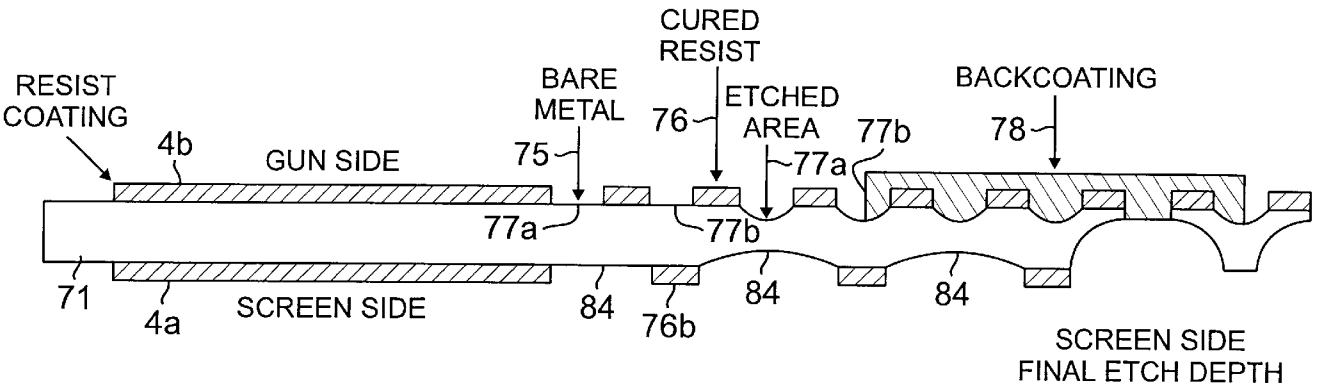

FIGS. 6*a* through 6*c* depict an exemplary embodiment of a process 60 for manufacturing the exemplary embodiment 50 shown in FIG. 5. The process 60 begins with the raw material (i.e., metal) 71 as shown in FIG. 6*b*, which shows the raw material 71 in various stages during the process 60 in a top view. FIG. 6*c* shows the affects of the process 60 on the raw material 71 in a cross-sectional view in the same stages.

While not shown, the steel may be pretreated in a known manner with degreasing, nitric acid pre-etch, and an alkaline passivation to ensure proper adherence of the resist, and consequently more uniform and predictable etching, as would be apparent to those of skill in the art.

First, in step 62 the metal 71 is coated with resist in a known manner on both the gun side 4*b* and the screen side 4*a*. One exemplary embodiment of the resist coating includes a mixture of the following chemicals: casein, ammonium hydroxide, reagent grade ammonium dichromate and water. Examples of each of these chemicals are listed in the table below.

| Sony Code | Manufacturer Code | Description | Wt. % | Formula wt. (lb) | Formula Vol. (gal) |
|---|---|---|---|---|---|
| APG008 | Alacid 7650 | Acide precipitated casein | 12.00% | 496.26 | |
| APG017 | | Ammonium hydroxide 26 Deg Be | 0.88% | 36.19 | 4.84 |
| APG001 | YY022 | Ammonium Dichromate, Reagent Grade | 0.80% | 32.88 | |
| | | Deionized water | 86.33% | 3,570.19 | 428.59 |
| | | | 100.00% | 4,135.51 | 482.00 |

Other resist coatings are possible, depending upon the particular etch to be used, as would be apparent to those of skill in the art.

Next in step 63, the print image 85 is applied to the resist coated metal 72 in the print room. U.S. Pat. No. 4,061,529 describes a technique for applying an etch-resistant stencil to a metal surface, such as cold-rolled steel, which patent is hereby incorporated by reference including the drawings as if repeated herein in its entirety. The method described in U.S. Pat. No. 4,061,529 is suitable for use herein to apply the print image to the steel tape.

In step 64, the print image 85 is then developed on the resist coated metal 72 in a known manner. Thus, certain areas of the metal 71 are shielded with the desired artwork. In the developing step 64, the resist is removed at certain points leaving cured resist 76 elsewhere and bare metal 75, as can be seen in FIG. 6*c*. In this step 64, exposure to actinic light causes the photoreduction of $Cr^{+6}$ within the film to $Cr^{+3}$, which forms coordinative bonds with the amide groups within the milk protein. The pH of the film and residual moisture have a large impact on the photosensitivity. Increased pH levels result in reduced photosensitivity while increased residual film moisture provides for increased photosensitivity.

Next in step 65, the exposed areas 74 are etched using an acid, such as ferric chloride. The etch rate of AG steel is a function of steel composition, grain size, ferric chloride, specific gravity, temperature, spray pressure, $FeCl_3/FeCl_2$ ratio and photoresist opening size. Refreshment of the $FeCl_2$ boundary layer next to the steel is critical to maintaining a uniform etch rate. The etch factor "b/a" is defined as the depth etch divided by the lateral etch, where "b" is the etch depth and "a" is the lateral etch width. As the photoresist opening is narrowed the tendency for sub-zone vortices have a lower bulk fluid velocity and consequently a larger $FeCl_2$ boundary layer adjacent to the steel. Consequently, as the artwork line decreases the etch factor also decreases.

The etch includes bare metal areas marked 77*a*, 77*b* and 84. Etched area 77*a* forms part of the taper on the final aperture grill tape 83 (FIG. 6*d*). Etched area 77*b* forms the channel. Etched area 84 becomes the sides including the taper of the aperture grill tape 83, which are formed in a two-step etch (see element 80 FIG. 6*c*). Due to the difference in the relative spacing between the cured sections 76 on the screen side 76*b* and the gun side 76*a*, wider channel etch 84 is made on the screen side 4*a* than to the gun side 4*b*.

Next in step 66, the back coat 78 is applied to the gun side 4*b* prior to the final etch in step 67. One exemplary embodiment of the back coat is a 100% solids mixture of acrylic esters, extender pigments, additives and photoinitiators. When exposed to ultraviolet radiation from a medium pressure mercury lamp, the back coat will undergo free radical polymerization.

The final etching is performed in step 67. This etching removes all of the metal (see element 80) to the point of the back coat 78 as can be seen in FIG. 6*c*. The same etching process is used as in step 65.

The back coating 78 is removed in a stripping process in step 68. In the stripping process —OH hydroxyl groups react with the $—H^1$ groups present from the pendant carboxyl lie acid to form an organic salt and salt and water. This organic salt is soluble in pendant —COOH groups within the polymer matrix the faster the strip time. Excessive film acid value, however, can cause film softening within the etcher.

Next in step 69, the finished aperture grill 4 is cleaned and cut out in sections. Each aperture grill 82 is formed in segments from the roll of steel tape 71. This process 60 forms the aperture grill with multiple aperture grill tapes, each of which has the desired cross-sectional shape, which includes a center etched longitudinal channel in the gun side of the aperture tape, as shown in FIG. 6*d*.

Although various embodiments are specifically illustrated and described herein, it will be appreciated that modifications and variations of the invention are covered by the above teachings and within the purview of the appended claims without departing from the spirit and intended scope of the invention. For example, while several exemplary embodiments are provided for use in specific steps in the manufacturing process, other chemicals and techniques to perform the same process steps may be employed without departing from the scope of the invention. For example, any technique for performing etching will suffice to create the desired longitudinal channel in the aperture grill tape. Moreover, any technique (including non-etching techniques) for creating the longitudinal channel will suffice, such as drilling, grinding, etc. Consequently, the examples given should not be interpreted to limit the modifications and variations of the invention covered by the claims but are merely illustrative of possible variations.

What is claimed is:

1. A cathode ray tube comprising:

a frame; and an aperture grill fastened to the frame, said aperture grill including a plurality of aperture grill tapes held in tension by the frame, each of said aperture grill tapes having a screen side and a gun side, and each of said aperture grill tapes having a channel extending throughout an entire length of each of said aperture grill tapes and disposed on the gun side.

2. The cathode ray tube according to claim 1, wherein the channel of the aperture grill tape comprises an etched channel.

3. The cathode ray tube according to claim 1, wherein a width of the aperture grill tape is larger on the gun side than the screen side.

4. The cathode ray tube according to claim 3, wherein the aperture grill tape includes a taper on its edges between the screen side than the gun side.

5. The cathode ray tube according to claim 3, wherein the aperture grill tape has two tapered edges.

6. A cathode ray tube comprising:

a glass screen having a plurality of phosphor stripes disposed thereon;

an electron beam gun emitting electrons towards the phosphor stripes on the glass screen;

a frame attached to the glass screen; and an aperture grill attached to the frame, said aperture grill including a plurality of aperture grill tapes held in tension by the frame, each of said aperture grill tapes having a screen side facing the screen and a gun side facing the electron gun, and each of said aperture grill tapes having a cutout portion extending throughout an entire length of each of said aperture grill tapes and disposed on the gun side.

7. The cathode ray tube according to claim 6, wherein the cutout portion of each of the aperture grill tapes comprises an etched channel.

8. The cathode ray tube according to claim 6, wherein a width each of the aperture grill tapes is larger on the gun side than the screen side.

9. The cathode ray tube according to claim 8, wherein each of the aperture grill tapes includes a taper on its edges between the screen side and the gun side.

10. The cathode ray tube according to claim 8, wherein each of the aperture grill tapes has two tapered edges.

* * * * *

UNITED STATES PATENT AND TRADEMARK OFFICE

CERTIFICATE OF CORRECTION

PATENT NO. : 6,686,685 B2
DATED : February 3, 2004
INVENTOR(S) : Paul A. Hollinger It is certified that error appears in the above-identified patent and that said Letters Patent is hereby corrected as shown below:

Column 1,
Line 12, after heading "BACKGROUND OF THE INVENTION", insert paragraph -- The present invention relates generally to cathode ray tubes, and more particularly to an aperture grill for use in a cathode ray tube. --

Column 5,
Line 29, after "screen side", change "than" to -- and --.

Column 6,
Line 21, after "width", insert -- of --.

Signed and Sealed this

Twenty-second Day of June, 2004

JON W. DUDAS
*Acting Director of the United States Patent and Trademark Office*